United States Patent [19]

Imre

[11] 4,311,107

[45] Jan. 19, 1982

[54] WIND PROPELLED APPARATUS

[76] Inventor: Laszlo Imre, 750 Stierlin Rd. #136, Mountain View, Calif. 94043

[21] Appl. No.: 85,338

[22] Filed: Oct. 16, 1979

[51] Int. Cl.[3] ..... B63H 9/08; B63B 15/00

[52] U.S. Cl. ..... 114/39; 9/310 E; 114/90; 114/97; 114/102; 403/226

[58] Field of Search ..... 9/310 E; 114/39, 90, 114/97-99, 102; 403/132, 133, 226, 227

[56] References Cited

U.S. PATENT DOCUMENTS

| | | | |
|---|---|---|---|
| 80,884 | 8/1868 | Stevens et al. . | |
| 105,554 | 7/1870 | Denton | 114/90 |
| 641,321 | 1/1900 | Perkins . | |
| 1,732,648 | 10/1929 | Flintermann . | |
| 1,867,358 | 7/1932 | Harness . | |
| 2,101,078 | 12/1937 | Lord et al. | 403/220 |
| 2,353,007 | 7/1944 | Blackman . | |
| 3,090,340 | 5/1963 | McCutchen et al. | 114/102 |
| 3,187,800 | 1/1970 | Schweitzer . | |
| 3,996,868 | 12/1976 | Schagen . | |
| 4,011,021 | 3/1977 | Hartz . | |
| 4,073,254 | 2/1978 | Marker . | |

FOREIGN PATENT DOCUMENTS

| | | | |
|---|---|---|---|
| 2636457 | 2/1978 | Fed. Rep. of Germany | 114/39 |
| 2712018 | 9/1978 | Fed. Rep. of Germany | 114/102 |

*Primary Examiner*—Joseph J. Rolla
*Attorney, Agent, or Firm*—Phillips, Moore, Weissenberger, Lempio & Majestic

[57] ABSTRACT

An improved wind-propelled apparatus is disclosed which includes a body mounting a stub mast generally orthogonal thereto. The stub mast is mounted in a well formed on the body and secured by a sleeve, resilient annulus and plug combination. Mounted on the stub mast is a generally vertical sail mast which is rotatable about a vertical axis. The stub mast also mounts a boom of sufficient length as to be capable of passing under the sail and having an eye and strap arrangement for securing the boom on either side of the sail.

9 Claims, 5 Drawing Figures

WIND PROPELLED APPARATUS

DESCRIPTION

1. Technical Field

The invention relates to a wind-propelled apparatus such as a surfboard having a sail attached thereto.

2. Background Art

Sailing has been a popular sport for centuries. More recently, it has become popular to attach a mast and sail to a surfboard and to use the resulting craft for recreation.

In one type prior art sailing surfboard, the bottom of the mast is pivotally mounted by a universal joint to the surfboard. Such an apparatus is taught, for example, in U.S. Pat. No. 3,187,800 issued Jan. 6, 1970 to H. Schweitzer, et al. and in U.S. Pat. No. 3,996,868, issued Dec. 14, 1976 to F. Schagen.

Such apparatus have the disadvantage that if the mast is released it will fall over and strike and enter the water. Lifting and repositioning the sail can be difficult and requires the development of considerable skill. Further, relatively great skill is needed to properly balance the mast and sail against the wind. Still further, because of the necessity for such careful balance, the height of the sail is generally limited to about 4.25 meters, although particularly skilled users can use somewhat longer masts. Yet further, such apparatus includes a pair of booms, one on each side of the mast. This allows the sail angle at the clew to be over 90° whereby the tack is near the surfboard to give maximum sail area for a given mast height yet still retain the ability to control the sail from either side of the surfboard. The use of the two booms, however, adds undesired weight to the apparatus. Further, the boom on the leeward side of the sail must bulge outwardly enough to allow the sail to fill with air, thus limiting the size of the air pocket in the sail.

Another prior art apparatus, namely that shown in U.S. Pat. No. 4,073,254 issued Feb. 14, 1978 to Hannes Marker, solves the problem of a falling mast by providing a resilient mount for the bottom of the mast and having the mast rotatable relative to the surfboard. However, the apparatus of U.S. Pat. No. 4,073,254 utilizes a pair of booms which creates the problems discussed above. Further, the resilient mounting of the bottom of the mast to the board is atop the surface of the board and may add to wind resistance.

It would be desirable to have a wind propelled apparatus which did not suffer from any of the disadvantages of prior art apparatus, which could utilize a larger sail thus providing a higher speed, particularly on calm days, which did not require as much skill to operate, which had a sail which would not fall in the water when the mast is released, which utilized only a single boom, and which did not have a resilient mount which extended above the top surface of the board. The present invention is directed to providing just such an improvement.

DISCLOSURE OF INVENTION

The present invention is directed to overcoming one or more of the problems as set forth above.

In accordance with an embodiment of the present invention, an improvement is provided in a wind-propelled apparatus having a body supportable by water and adapted to support a user, a generally vertical mast generally orthogonal to body and a sail supported by the mast. The improvement comprises a stub mast generally orthogonal to the body and means for mounting a bottom portion of the stub mast to the body. The bottom end of a topmast is spaced from and free of connection with the body and the topmast is generally parallel to the stub mast. Means are provided for mounting the topmast to rotate about a generally vertical axis while it remains generally parallel to the stub mast.

In accordance with another embodiment of the present invention, the improvement comprises a boom attached at an aft end to the clew of the sail a spaced distance from the mast structure, the boom being sufficiently long to pass under the sail, and means for removably securing a mast end of the boom to the mast structure on either side of the sail.

In yet another embodiment of the invention, the improvement comprises a well extending downwardly into the body. A sleeve fits within the well and has an inwardly extending flange adjacent a top thereof. A resilient annulus is held within the sleeve by the flange. An outwardly extending foot adjacent a bottom of the mast is positioned beneath the annulus. A resilient member is positioned beneath the foot. An annular plug is beneath the resilient member and means are provided for engaging the plug with the sleeve for providing pressed contact between the flange, the annulus, the foot and the resilient member.

BRIEF DESCRIPTION OF DRAWING

The invention will be better understood by reference to the figures of the drawings wherein like numbers denote like parts throughout and wherein.

BEST MODE FOR CARRYING OUT THE INVENTION

While the invention is described principally in terms of its use with a surfboard, it should be realized that the invention is likewise operable with other sailing craft.

Figure 1:
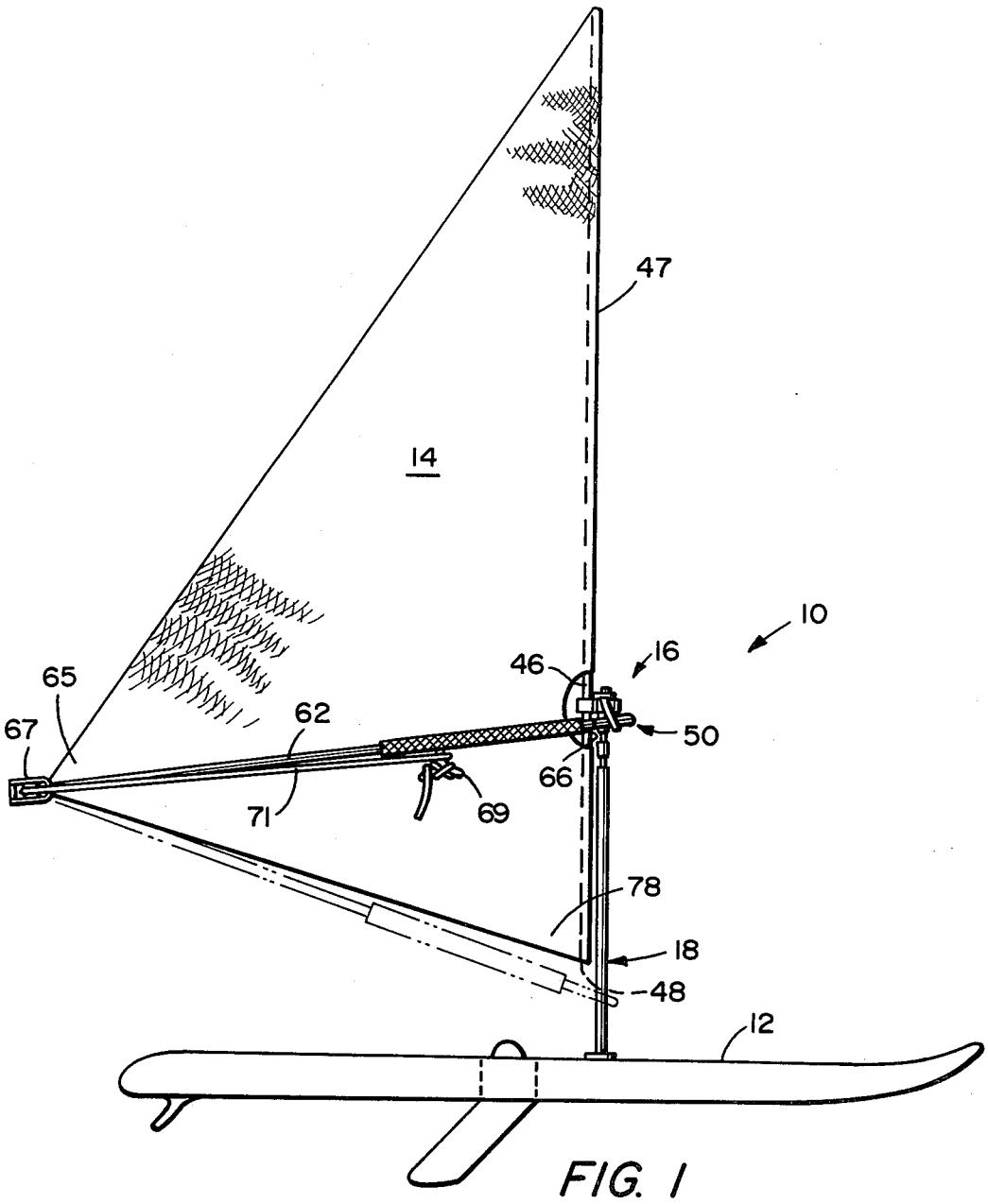
FIG. 1 illustrates in side view, partially in phantom, an apparatus in accordance with the present invention.

Adverting to FIG. 1, there is shown therein a wind propelled apparatus, more particularly a sailing surfboard 10, which includes a body or surfboard 12 to which a sail 14 is mounted in accordance with the present invention. A novel mast structure 16 is generally orthogonal to the board 12 and supports the sail 14.

In accordance with the present invention, a stub mast 18 extends generally vertically and orthogonal to the board 12. Means 20, shown in FIG. 3, serve for mounting a bottom portion 22 of the stub mast 18 to the board 12. Briefly, the stub mast mounting means 20 includes a sleeve 24 positioned within a well 26 in the board 12. The sleeve 24 has an inwardly extending flange 28 and an outwardly extending flange 30. The outwardly extending flange 30 generally sits atop the board 12. A resilient annulus 32 is held within the sleeve 24 by the inwardly extending flange 28. An outwardly extending foot 34 of the stub mast 18 is provided adjacent a bottom 36 thereof. The foot 34 is positioned beneath the annulus 32. A resilient member 38 sits beneath the foot 34. A plug 40 is positioned beneath the resilient member 38. Means, in the embodiment illustrated internal threads 42 on the sleeve 24 and external threads 44 on the plug 40, serve for engaging the plug 40 with the sleeve 24 for providing pressed contact between the inward flange 28, the annulus 32, the foot 34 and the resilient member 38.

Figure 3:
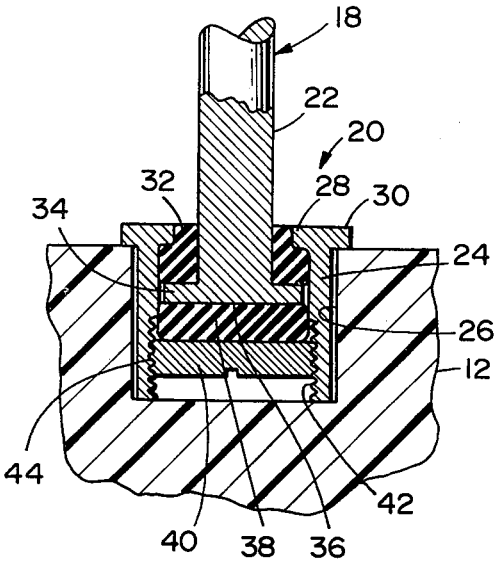
FIG. 3 illustrates, in side section, a detail in the mast mounting structure of the present invention.

It will be clear that the stub mast 18, is resiliently mounted in that if it is tilted, for example, 20° to 30° rightwardly in FIG. 3, the resilient member 38 will be compressed at the right while the resilient annulus 32 will be compressed at the left. Similarly, the stub mast 18 can be tilted to the left, forwardly, or rearwardly. However, it is clear that the stub mast 18 will not freely fall into the water and is not universally mounted to the surfboard 12. Further, the plug 40 can be easily removed so as to replace the annulus 32 or the resilient member 38 should either of these become worn. Still further, the entire resilient stub mast mounting means 20 is beneath the top of the board 12 whereby it does not provide any resistance to wind.

Figure 4:
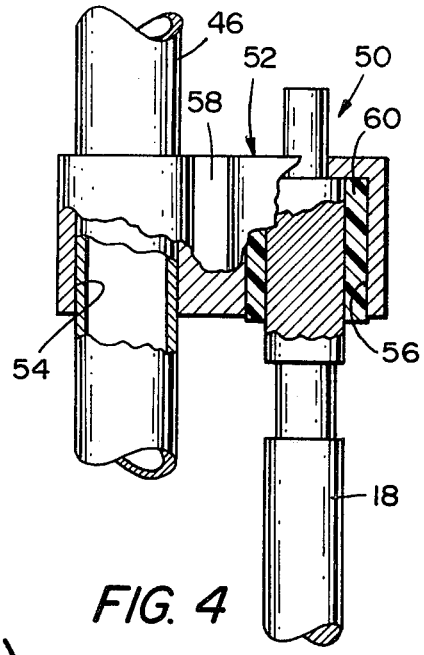
FIG. 4 illustrates, in side view partially in section, a detail in the mounting of the mast of the present invention.
Figure 5:
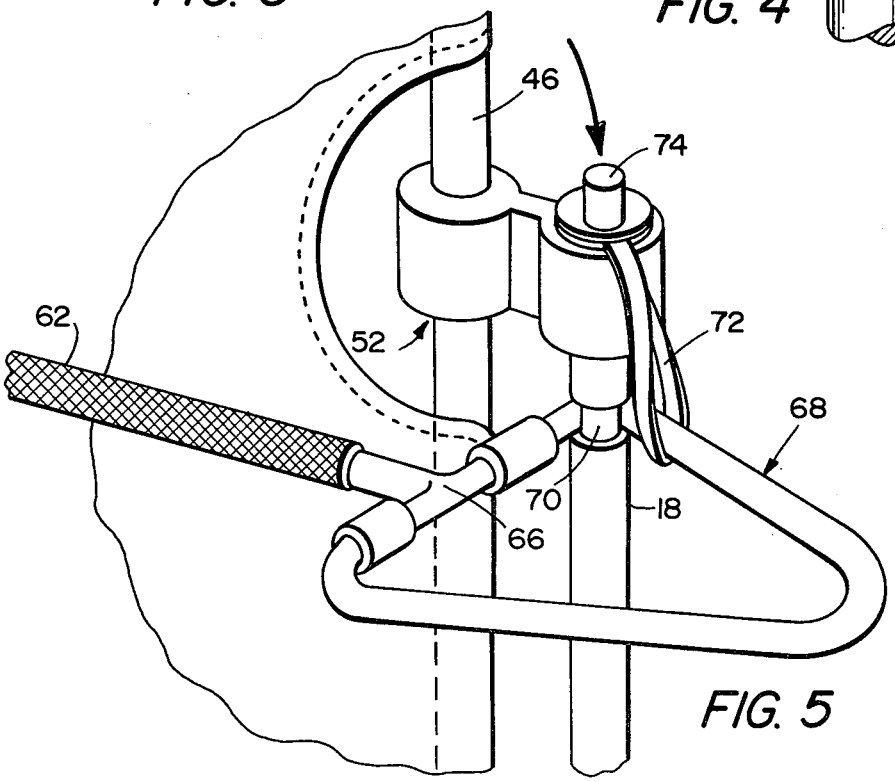
FIG. 5 illustrates, in perspective, a detail in the boom engagement mechanism in accordance with the present invention.

Adverting to FIGS. 1, 4 and 5, it will be seen that the mast structure 16 includes a topmast 46 in addition to the stub mast 18. The topmast 46 may be sewn into a conventional pocket in the luff 47 of the sail 14, as illustrated. Adverting to FIG. 1, a bottom end 48 of the topmast 46 is spaced from and free of connection with the board 12. Further, the topmast 46 is held generally parallel to the stub mast 18.

In accordance with the present invention means 50, seen best in FIG. 4, are provided for mounting the topmast 46 to rotate while it remains generally parallel to the stub mast 18. The mounting means illustrated is a member 52 having a pair of parallel bores 54 and 56 therethrough and being connected together by a bridge 58. The bore 54 is generally fixidly attached to the topmast 46. A bearing 60 may fit within the bore 56. The bearing 60 then is rotatingly mounted to the stub mast 18. Alternatively (not illustrated), the bearing 60 may be omitted and the bore 56 directly rotatingly mounted to the stub mast 18. This allows rotating of the topmast 46 about the stub mast 18.

Figure 2:
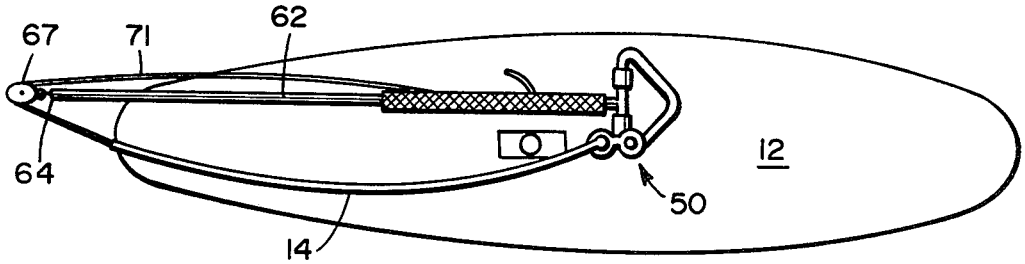
FIG. 2 illustrates a plan view of the apparatus of FIG. 1, but with the boom shifted to an opposite side of the sail and with the sail having a larger pocket.

It has previously been mentioned that the bottom end 48 of the topmast 46 is spaced from and free from connection with the board 12. This is important for cooperation with a single boom 62 as seen in FIGS. 1, 2 and 5. Briefly, the single boom 62 is attached at an aft end 64 thereof to the sail 14 a spaced distance from the topmast 46, namely to the clew 65 of the sail 14. The clew 65 has an angle above 90° so that the tack 78 of the sail 14 is near the board 12. This provides maximum sail area for a given sail height. A pulley 67 and cleat 69 along with a sheet 71 allow a foot 73 of the sail 14 to bulge away from the boom 62, contrary to prior art apparatus which have a leeward boom, as well as a windward boom, limiting the set of the sail.

In accordance with the present invention, means are provided for removably securing a mast end 66 of the boom 62 to the stub mast 18. This is shown most clearly in FIG. 5. The preferred removably securing means includes an eye 68, shown in generally a triangular shape in FIG. 5, which extends from the boom mast end 66 and about the stub mast 18. Means are also provided for engaging the stub mast 18 with the eye 68. In particular, the stub mast 18 has an undercut 70 for accomplishing this engagement. Further, a strap 72 is engaged with the eye 68 and also fits over a top end 74 of the stub mast 18. When the strap 72 is released, the eye 68 can be moved out of engagement with the underut 70 by simply pulling or pushing the boom 62. Thereafter, the boom 62 can be moved, downwardly beneath the foot 73 of the sail 14 to the position shown in phantom in FIG. 1, and then moved under the sail 14 to the other side thereof. Then, the boom 62 can be moved up the other side of the sail 14 and into the position shown in FIG. 2. It is clear that a symmetrical engagement of the eye 68 with the undercut 70 on the stub mast 18 is accomplished when the boom 62 is in the position shown in FIG. 2. It is also clear that the boom 62 must be sufficiently long, and the play in the eye 68 sufficient, to pass the boom 62 under the sail 14 and under the topmast 46, when the eye 68 is moved sufficiently downwardly on the stub mast 18, particularly to the position shown in FIG. 1.

INDUSTRIAL APPLICABILITY

An apparatus as taught herein is particularly useful for surfboards which bear sails. Further, the apparatus is particularly advantageous in that the mast cannot fall over, only a single boom is necessary and the resilient mounting means for the stub mast is below the surface of the board and does not create wind drag.

Other aspects, objects and advantages of this invention can be obtained from a study of the drawings, disclosure and the appended claims.

I claim:

1. In a wind-propelled apparatus (10) which comprises a body (12) supportable by water and adapted to support a user, a generally vertical mast (46) generally orthogonal to the body (12) and a sail (14) supported by the mast (46), an improvement comprising:

a stub mast (18) generally vertical and generally parallel to the mast (46);

means (20) for mounting a bottom portion (22) of the stub mast (18) to the body (12);

wherein a bottom end (48) of the mast (46) is spaced from and free of connection with the body (12); and means (50) for mounting the mast (46) to the stub mast (18) and in rotating relation about a generally vertical line.

2. An improvement as in claim 1, wherein the stub mast (18) mounting means (20) resiliently mounts the stub mast (18) to the body (12).

3. In a wind-propelled apparatus (10) which comprises a body (12) supportable by water and adapted to support a user, a generally vertical mast (46) generally orthogonal to the body (12) and a sail (14) supported by the mast (46), an improvement comprising:

a stub mast (18) generally parallel to the mast (46);

means (20) for mounting a bottom portion (22) of the stub mast (18) to the body (12);

wherein a bottom end (48) of the mast (46) is spaced from and free of connection with the body (12);

means (50) for mounting the mast (46) in rotating relation to the stub mast (18);

a boom (62) having an aft end (64) and a mast end (66);

means for attaching said aft end (64) to a clew (65) of said sail (14); and means (68, 70, 72) for removably securing said mast end (66) to the stub mast (18).

4. An improvement as in claim 3, wherein the removably securing means (68, 70, 72) includes an eye (68) extending from the mast end (66) about the stub mast (18) and means (70) for engaging the stub mast (18) with the eye (68), and wherein the boom (62) is sufficiently long and the eye (68) has sufficient play to pass the boom (62) under the sail (14) and under the mast (46) when the eye (68) is moved sufficiently downwardly on the stub mast (18).

5. In a wind-propelled apparatus (10) which comprises a body (12) supportable by water and adatped to support a user, a generally vertical mast (46) generally orthogonal to the body (12) and a sail (14) supported by the mast (46), an improvement comprising:

a stub mast (18) generally parallel to the mast (46);

means (20) for mounting a bottom portion (22) of the stub mast (18) to the body (12);

wherein a bottom end (48) of the mast (46) is spaced from and free of connection with the body (12);

means (50) for mounting the mast (46) in rotating relation to the stub mast (18); and wherein the body (12) includes a well (26) extending thereinto from above and wherein the stub mast (18) mounting means (20) includes (a) a sleeve (24) positioned within the well (26) having an inwardly extending flange (28) adjacent a top thereof, (b) a resilient annulus (32) held within the sleeve (24) by the flange (28), (c) an outwardly extending foot (34) adjacent a bottom of the stub shaft (18) positioned beneath the annulus (32), (d) a resilient member (38) beneath the foot (34), (e) an annular plug (40) beneath the resilient member (38) and (f) means for engaging the plug (40) with the sleeve (24) for providing pressed contact between the flange (28) the annulus (32), the foot (34) and the resilient member (38).

6. An improvement as in claim 5, wherein the plug-sleeve engaging means includes internal threads (42) on the sleeve (24) and external threads (44) on the plug (40).

7. In a wind-propelled apparatus (10) which comprises a body (12) supportable by water and adapted to support a user, a generally vertical mast structure (16) generally orthogonal to the body (12) and a sail (14) supported by the mast structure (16), the improvement comprising:

a boom (62) have an aft end (64) and a boom end (66) and attached at said aft end (64) to the sail (14) a spaced distance from the mast structure (16), the boom (62) being sufficiently long to pass under the sail (14); and means (68, 70, 72) for removably securing said mast end (66) to the mast structure (16) with said boom (62) on either side of the sail (14).

8. In a wind-propelled apparatus (10) which comprises a body (12) supportable by water and adapted to support a user, a generally vertical mast (46) generally orthogonal to the body (12) and a sail (14) supported by the mast (46), an improvement comprising:

a stub mast (18) generally parallel to the mast (46);

means (20) for mounting a bottom end portion (22) of the stub mast (18) to the body (12);

wherein a bottom end (48) of the mast (46) is spaced from and free of connection with the body (12);

means (50) for mounting the mast (46) in rotating relation to the stub mast (18);

a pulley (68) adjacent the aft end (64) of the boom (62); and a sheet (71) reeved over the pulley (67) and connected to the clew (65) of the sail (14).

9. In a wind-propelled apparatus (10) which comprise a body (12) supportable by water and adapted to support a user, a generally vertical mast structure (16) generally orthogonal to the body (12) and a sail (14) supported by the mast structure (16), the improvement comprising:

said body (12) having a well (26) extending downwardly thereinto;

a sleeve (24) within said well (26) having an inwardly extending flange (28) adjacent a top thereof;

a resilient annulus (32) held within said sleeve (24) by said flange (28);

an outwardly extending foot (34) adjacent a bottom (36) of the mast structure (16) and positioned beneath the annulus (32);

a resilient member (38) beneath said foot (34);

an annular plug (40) beneath the resilient member (38); and means for engaging the plug (40) with the sleeve (24) for providing pressed contact between the flange (28), the annulus (32), the foot (34) and the resilient member (38).

* * * * *